US006384793B2

(12) United States Patent
Scordilis

(10) Patent No.: US 6,384,793 B2
(45) Date of Patent: May 7, 2002

(54) SLOT ANTENNA DEVICE

(75) Inventor: Thierry Scordilis, St. Martin d'Hères (FR)

(73) Assignee: Allgon AB, Akesberga (SE)

( * ) Notice: Subject to any disclaimer, the term of this patent is extended or adjusted under 35 U.S.C. 154(b) by 0 days.

(21) Appl. No.: 09/735,928

(22) Filed: Dec. 14, 2000

(30) Foreign Application Priority Data

Dec. 16, 1999 (SE) ..... 9904617

(51) Int. Cl.[7] ..... H01Q 13/10
(52) U.S. Cl. ..... 343/767; 343/702; 343/841
(58) Field of Search ..... 343/700 MS, 702, 343/767, 770, 841, 846, 848

(56) References Cited

U.S. PATENT DOCUMENTS

| | | | | |
|---|---|---|---|---|
| 4,924,237 A | | 5/1990 | Honda et al. | 343/702 |
| 5,394,160 A | * | 2/1995 | Iwasaki et al. | 343/702 |
| 5,874,920 A | | 2/1999 | Araki et al. | 343/702 |
| 5,914,693 A | | 6/1999 | Takei et al. | 343/767 |
| 5,945,954 A | * | 8/1999 | Johnson | 343/702 |
| 6,031,503 A | * | 2/2000 | Preiss, II et al. | 343/770 |
| 6,181,283 B1 | * | 1/2001 | Johnson et al. | 343/702 |
| 6,195,048 B1 | * | 2/2001 | Chiba et al. | 343/700 MS |

FOREIGN PATENT DOCUMENTS

| | | |
|---|---|---|
| EP | 0 531 164 A1 | 10/1993 |
| EP | 0 623 967 A1 | 11/1994 |
| EP | 0 738 023 A2 | 10/1996 |
| EP | 0 752 735 A1 | 1/1997 |
| EP | 0 851 531 A2 | 7/1998 |
| EP | 0 878 863 A2 | 11/1998 |
| EP | 0 929 121 A1 | 7/1999 |
| WO | WO 94/15378 | 7/1994 |
| WO | WO 98/49743 | 11/1998 |
| WO | WO 99/13528 | 3/1999 |

* cited by examiner

*Primary Examiner*—Tan Ho
(74) *Attorney, Agent, or Firm*—Volentine Francos, PLLC.

(57) ABSTRACT

A slot antenna device for transmitting and/or receiving radio frequency (RF) waves, connectable to a radio communication device including signal processing circuitry, includes a substantially planar conductive antenna element provided with a slot, and with feeding and grounding points respectively located at opposite sides of the slot; a substantially planar RF ground conductor located substantially in parallel with the planar conductive antenna element; a grounding connector connecting the planar ground conductor to the grounding point; and a feeding connector connecting the signal processing circuitry to the feeding point. The antenna device is connectable to the radio communication device such that the planar ground conductor is located between the conductive antenna element and the signal processing circuitry, to effectively shield the circuitry from RF waves.

35 Claims, 4 Drawing Sheets

SLOT ANTENNA DEVICE

This application claims priority under 35 U.S.C. §119 to Swedish Application No. 9904617-9 filed on Dec. 16, 1999, which is hereby incorporated by reference in its entirety for all purposes.

BACKGROUND OF THE INVENTION

1. Field of the Invention

The present invention generally relates to the field of antennas and particularly to a slot antenna device for transmitting and/or receiving radio frequency waves, and to a portable radio communication device including such a slot antenna device.

2. Description of the Related Art

In radio communication systems of today, there is an increasing demand for availability and small sized user terminals thereof. This puts high requirements on the antenna devices of these user terminals to be compact and to exhibit good antenna performance.

Antenna devices including a helical element in combination with an extendible whip antenna have been used for hand portable user terminals in order to achieve compact dimensions and durability, while still maintaining high radiation efficiency. Also, permanently protruding external antenna devices are used extensively.

Recently, attention has also been focused on antenna devices mounted inside the housing of hand portable terminals. Thereby, protruding antenna parts are avoided, lower radiation intensity towards the user may be obtained, and possibilities for further reductions of the size of the terminals are enabled, since many of these internal antenna devices may be achieved by means of thin film technology.

One solution includes a coaxial slot antenna installed in a radio communication device including an entire strip conductor arranged inside a flat conductive cubic, such that the strip conductor is insulated from the conductive cubic. The cubic is provided with a U-shaped slot crossing the strip conductor along the length thereof and in the height direction thereof. In one embodiment of this solution, a radio communication device has the coaxial slot antenna device embedded in a multilayer RF circuit board (PCB) mounted in parallel with and elevated from a base band terminal PCB. Further, the antenna RF PCB is provided with RF circuitry and additional circuitry. The antenna RF PCB and the terminal base band PCB are interconnected by a connector. The uppermost layer of this embodiment includes the coaxial slot antenna and RF circuitry laterally separated therefrom. A second layer is provided with power supply and control circuitry, and a third layer is connected to ground. A fourth layer is provided with intermediate frequency components, which are connected to base band circuitry arranged on the terminal base band PCB.

However, such an antenna structure of the above noted solution is not easily made very compact, operable in multiple bands or adaptively impedance matchable. Further, the structure is a rather complex, which due to required tolerances on the coupling with the feed, makes the structure difficult and expensive to manufacture. Also, the structure has no explicit shielding around the RF circuitry.

Additionally, when the terminals are manufactured to be smaller, the distances between various parts such as base band circuitry, RF circuitry, and radiating structures of the terminal become smaller, and thus electrical disturbances and interference between the various parts are increased.

There is thus a need to provide a readily manufactured compact antenna device to be installed in a compact terminal, the antenna device reducing the amount of disturbances and interference in the terminal.

SUMMARY OF THE INVENTION

The present invention is therefore directed to an antenna device for a radio communication device which substantially overcomes one or more problems due to the limitations and disadvantages of the related art.

An object of the present invention is to provide an antenna device for a radio communication device, which exhibits an overall improved performance in comparison with antenna devices of the related art.

It is in this respect an object of the invention to provide an antenna device, which is easy and cheap to manufacture, easy to install and which enables an efficient use of the available space, and which exhibits good antenna performance.

Another object of the invention is to provide an antenna device, which is insensitive to conductive portions, such as e.g. a conductive radio communication device casing or the hand of a user, in the proximate environment of the antenna device.

It is a further object of the invention to provide an antenna device which when installed in a radio communication device exhibits, together with the radio communication device, reduced losses, e.g. due to resistivity in connection lines, as compared with radio communication devices of the related art.

It is yet a further object of the invention to provide an antenna device as an easily installable module including processing circuitry for RF signals.

It is a still further object of the invention to provide an antenna device that is small, lightweight and reliable, particularly mechanically durable.

It is an additional object of the invention to provide an antenna device suited to be used as an integral part of a radio communication device.

It is yet an additional object of the invention to provide an antenna device adapted for operation in at least two different frequency bands.

These objects among others are, according to the invention, attained by an antenna device that is connectable to a radio communication device including signal processing circuitry, the antenna device including a substantially planar conductive antenna element provided with a feeding point, a grounding point and a slot located between the feeding point and the grounding point; a substantially planar RF ground conductor generally located in a plane substantially parallel with the planar conductive antenna element; a grounding connector that connects the planar RF ground conductor to the grounding point; and a feeding connector that connects the signal processing circuitry to the feeding point, the antenna device being connectable to the radio communication device such that the planar ground conductor be located between the planar conductive antenna element and the signal processing circuitry to shield the signal processing circuitry from the transmitted and/or received RF waves.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the invention, and wherein.

DETAILED DESCRIPTION OF PREFERRED EMBODIMENTS

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known devices and methods are omitted so as not to obscure the description of the present invention with unnecessary details. Also, is to be understood that the antenna system of the invention is operable to transmit or receive RF signals. Even if a term is used herein that suggests one specific signal direction, it is to be appreciated that such a situation can cover that signal direction and/or its reverse.

Figure 1A:
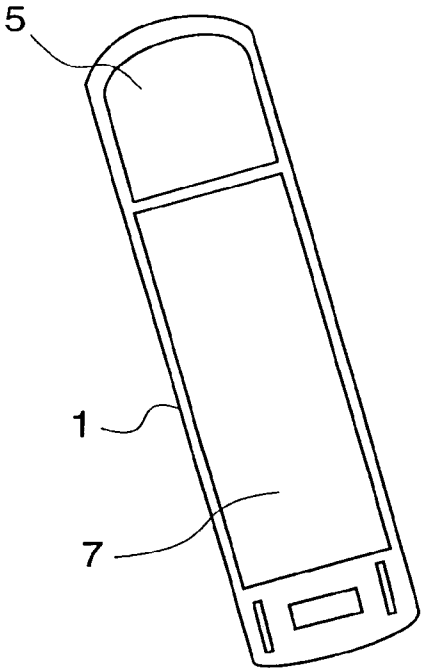
FIG. 1*a* is a perspective view of a portable telephone of an embodiment of the invention, without a casing.
Figure 1B:
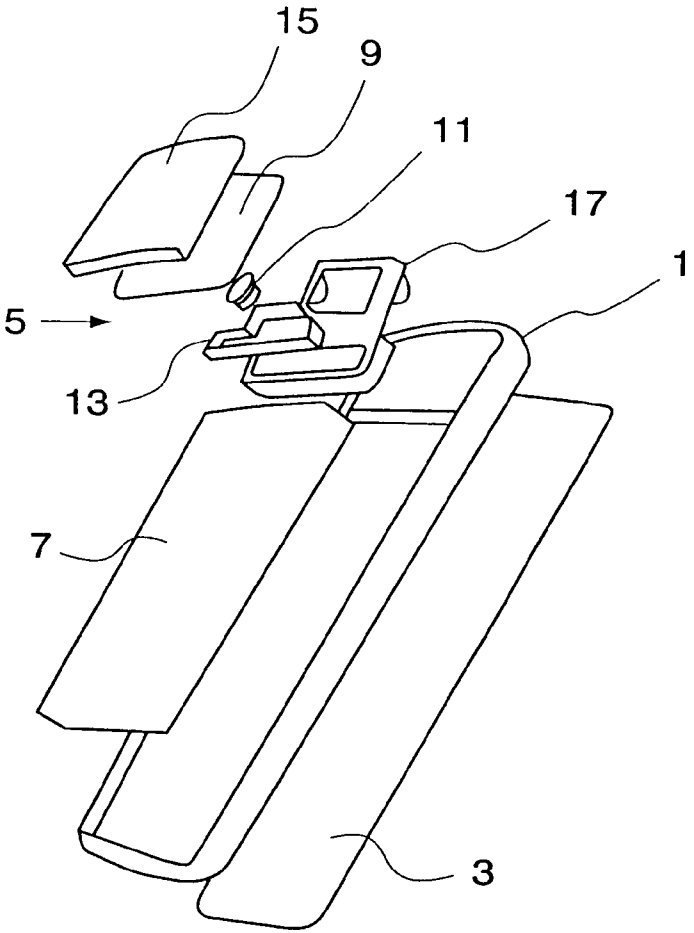
FIG. 1*b* is an exploded perspective view of the telephone of FIG. 1*a*, including a slot antenna device.

FIGS. 1*a* and 1*b* show a portable telephone for transmitting and receiving radio frequency (RF) waves. The telephone is shown without a casing in an assembled perspective view and an exploded perspective view, respectively, as seen from behind. In the Figures, reference numeral 1 is a chassis of the portable telephone. A main printed circuit board (PCB) 3 of the telephone is intended to be mounted at the front side of the chassis 1. PCB 3 includes any suitable signal processing circuitry (not shown) known in the art for the operation of the telephone. A slot antenna device 5 of the present invention is intended to be mounted at the back side of the chassis 1 together with a battery 7. The antenna device 5 includes a multilayer PCB-based antenna 9, a connector 11 for connection of an external antenna (not shown), and a shielding box 13 mounted at the bottom surface of the multilayer antenna 9 for shielding of electronics. Further, the antenna device includes a top cover 15 and a bottom cover 17. The antenna can alternatively be arranged on a flexible substrate or on a MID (Molded Interconnection Device) structure (not shown in the Figures).

Figure 2A:
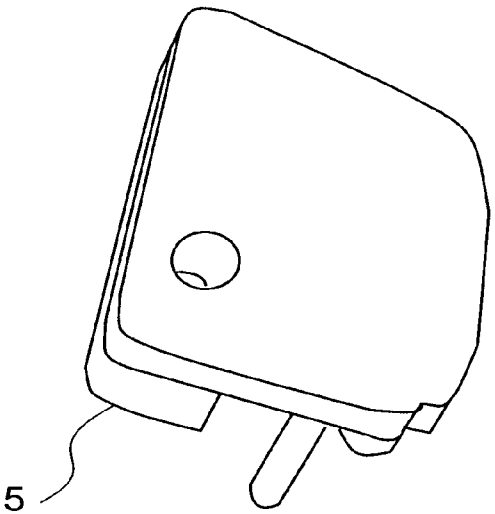
FIGS. 2*a* and 2*b* are respectively a perspective view and an exploded perspective view, of the slot antenna device of FIG. 1.
Figure 2B:
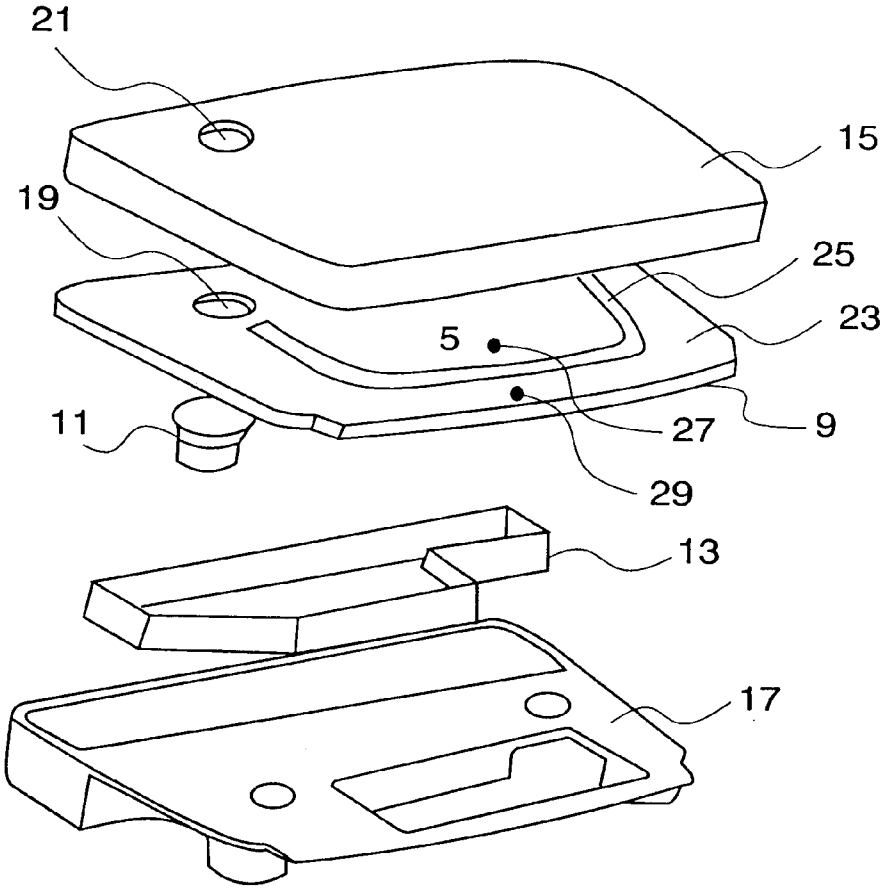

The inventive slot antenna device is shown more in detail in FIGS. 2*a* and 2*b*. FIG. 2*a* shows a perspective view of the slot antenna device 5 as assembled. Preferably, the antenna device is provided in the form of a plug and play module, which is easily installed into the portable telephone and which may also be easily removed therefrom.

With reference now to FIG. 2*b*, some further aspects of the antenna device will be depicted. The antenna 9 and the top cover 15 include respective apertures 19, 21 aligned with each other. The connector 11 is mounted through these apertures 19, 21 such that an external antenna, such as an antenna of a car (not shown), may be connected to the hand portable telephone. Further, the antenna 9 includes a substantially planar conductive patch 23, in which a U-shaped slot 25 is formed. The shape of the slot 25 may, however, have any suitable shape, such as, e.g., any of V, W, H and Ω shapes. A feeding point 27 and a grounding point 29, respectively, are arranged at opposite sides of the slot 25. The feeding point 27 is connected (not shown in FIGS. 2*a*, 2*b*) to signal processing circuitry arranged on PCB 3 of FIG. 1*b* and the grounding point 29 is connected to a substantially planar RF ground plane conductor (not shown in FIGS. 2*a*, 2*b*) included in the antenna 9.

The antenna 9 may be adapted for transmitting and/or receiving RF waves in at least two different frequency bands, wherein the slot 25 and the extension of the conductive antenna layer 23 are designed to obtain operation in the two different frequency bands.

Figure 3A:
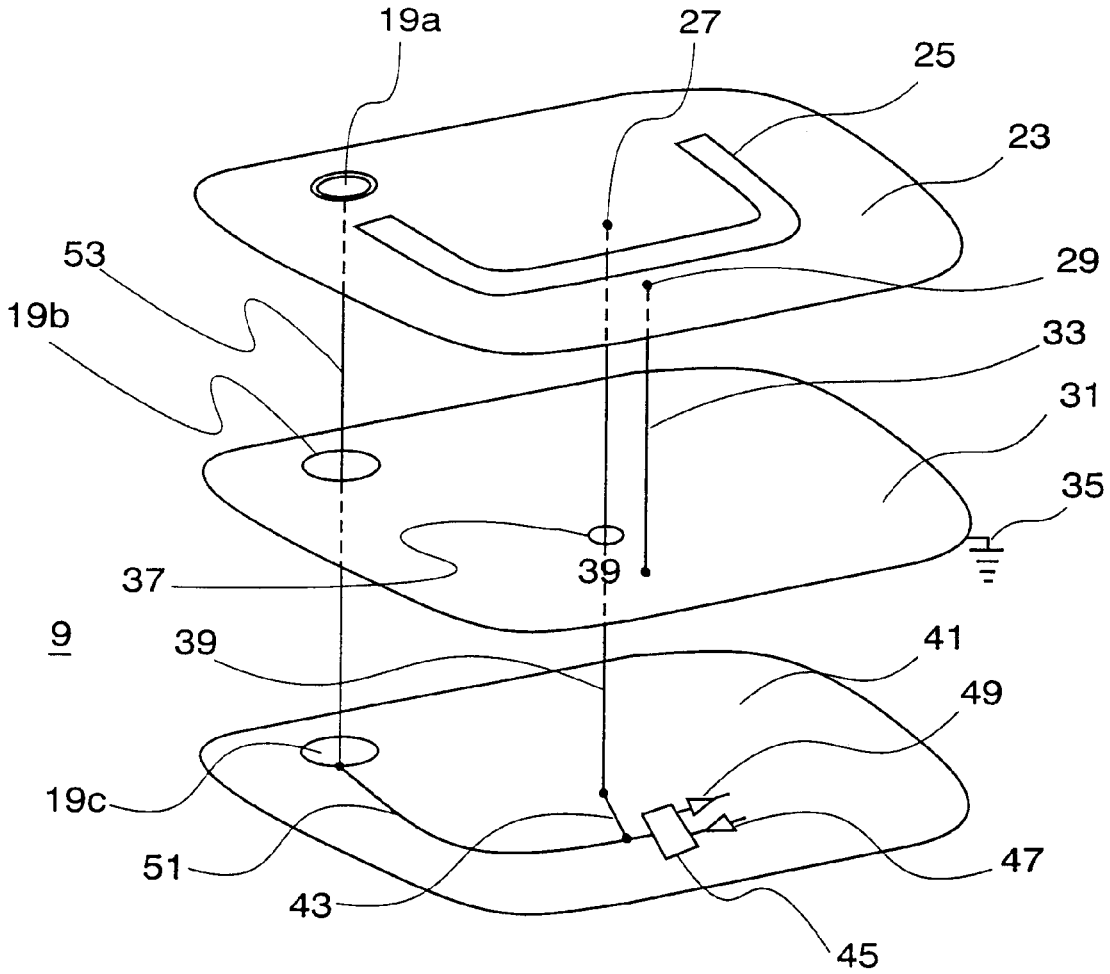
FIG. 3*a* is an exploded perspective view of a three-layer structure included in the slot antenna device of FIG. 2.
Figure 3B:
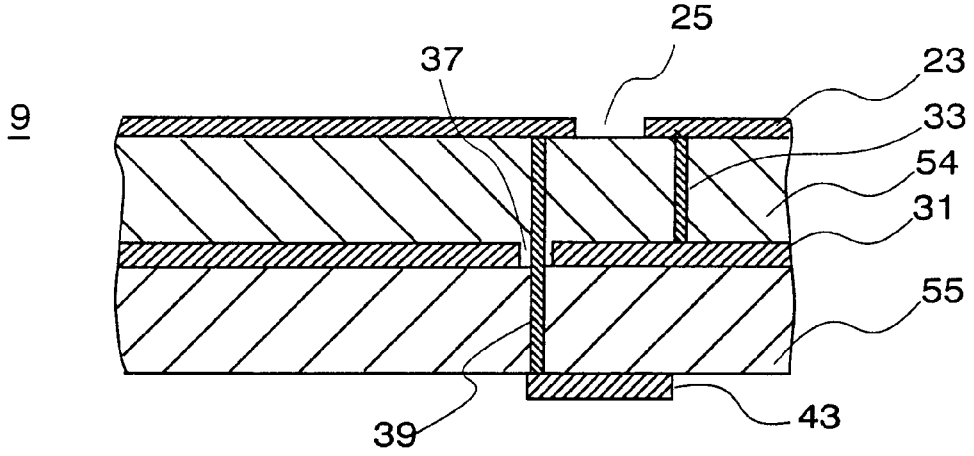
FIG. 3*b* is a cross-sectional view of the three-layer structure of FIG. 3*a*.

In FIG. 3*a* and 3*b*, antenna 9 is shown in more detail. FIG. 3*a* is a schematic exploded perspective view of antenna 9, which includes a three-metallic-layer structure. FIG. 3*b* is a cross-sectional view of the three-layer structure as taken along a line crossing through the feeding and grounding points 27 and 29, respectively.

As can be seen therein, the uppermost layer 23 is the above mentioned conductive patch layer provided with the slot 25, the feeding point 27 and the grounding point 29. The next conductive layer 31, which may be substantially parallel to the patch layer 23, is the above-mentioned substantially planar RF ground plane conductor. A metallic substantially vertical conductor 33 connects, resistively or capacitively, the grounding point 29 of the patch layer 23 to the ground plane conductor 31. Reference numeral 35 indicates the RF grounding of layer 31, which may be a common ground with the ground of PCB 3 in FIG. 1*b* (such interconnection is not explicitly shown in FIG. 1*a*) or which may be a separate ground. Further, an aperture 37 in the conductive layer 31 receives a feeding connector 39, which connects, resistively or capacitively, the feeding point 27 in the patch layer 23 to signal processing circuitry of the telephone PCB. The feeding connector 39 may be a coaxial line connector.

A bottom layer 41 provides electrical connections to feeding connector 39 and optionally to electric RF circuitry. In FIG. 3*a*, the layer 41 includes an electrical conductor 43, which connects the feeding connector 39 to a duplexer 45, which in turn is connected to a power amplifier 47 and a low noise amplifier 49 arranged in parallel. The power amplifier 47 and the low noise amplifier 49 are further connected to feeding circuitry and receiving circuitry, respectively, arranged on the telephone PCB 3 in FIG. 1*b*.

The aperture 19 of the antenna 9 as shown in FIG. 2*a* is indicated by reference numerals 19*a*, 19*b*, and 19*c* in layers 23, 31, and 41, respectively in FIG. 3*a*. Electrical connection from the duplexer 45 to the aperture 19*a* is provided through connectors 51 and 53.

Two dielectric layers are provided between the metallic layers to electrically insulate the conductive layers from each other (not shown in FIG. 3*a* for sake of simplicity). However, in FIG. 3*b*, these layers are denoted as layers 54 and 55. The thickness of the layer 54 is chosen so as to achieve suitable antenna performance of antenna 9. It shall be appreciated that the electrical connections 43, 51 and the electric components 45, 47, 49 on layer 41 are located on the bottom surface of a dielectric, which may be the layer 55, but may alternatively be a dielectric thin film, such as a flexible film (not shown).

The electric components 45, 47, 49 and the radiation shielding box 13 (see FIG. 2*b*) are arranged such that shielding box 13 surrounds the electric components 43, 47, 49 in all directions except in the direction of the ground plane conductor 31. The radiation-shielding box 13 may be in the form of a shielding can. The shielding box 13 can be a conductive material, or may be a conductive film on a surface thereof.

The electric components located at the antenna device 5 may in various embodiments, include any of a duplexer for separating transmission and reception lines, bandpass filter(s) for bandpass filtering signals fed to and/or received from the feeding point, a power amplifier for amplifying signals fed to the feeding point, at least one low noise amplifier for amplifying signals received from the feeding point, a frequency converter for frequency converting signals fed to and/or received from the feeding point, an analog-digital converter for converting received analog signals from the feeding point to digital form and a digital-analog converter for converting digital signals from the signal processing circuitry to an analog signal, which is fed to the feeding point.

The interface between the antenna PCB 9 and the telephone PCB 3 may be chosen to be at any suitable location along any RF circuitry line(s). For example, if all the above components are arranged on the antenna PCB 9, the antenna device 5 has only digital ports and thus, it may be referred to as a digital controlled antenna (DCA).

The antenna device of the present invention may indeed include any of the various components and features incorporated in antenna devices, which are depicted and detailed in commonly assigned, co-pending U.S. patent application Ser. Nos. 09/712,131; 09/712,133; 09/712,144; and 09/712,181, all filed on Nov. 15, 2000, which applications hereby are incorporated by reference.

It shall be noted that the antenna device is installable in and connectable to the telephone such that the ground plane conductor 31 will be located between conductive antenna elements 23, 25 and signal processing circuitry on PCB 3 to effectively shield the circuitry from transmitted and/or received RF waves. The ground plane conductor 31 is further located between conductive antenna element 23, 25 and any electric RF component located in the bottom layer 41 to effectively shield the electric RF component from transmitted and/or received RF waves. As can be seen from FIG. 3*a*, ground plane conductor 31 has planar extension that is substantially of the same size as the planar extension of conductive antenna element 23, 25. The ground plane conductor 31 may be of at least this size to obtain good antenna performance and to shield electric circuitry from radiation.

Figure 4A:
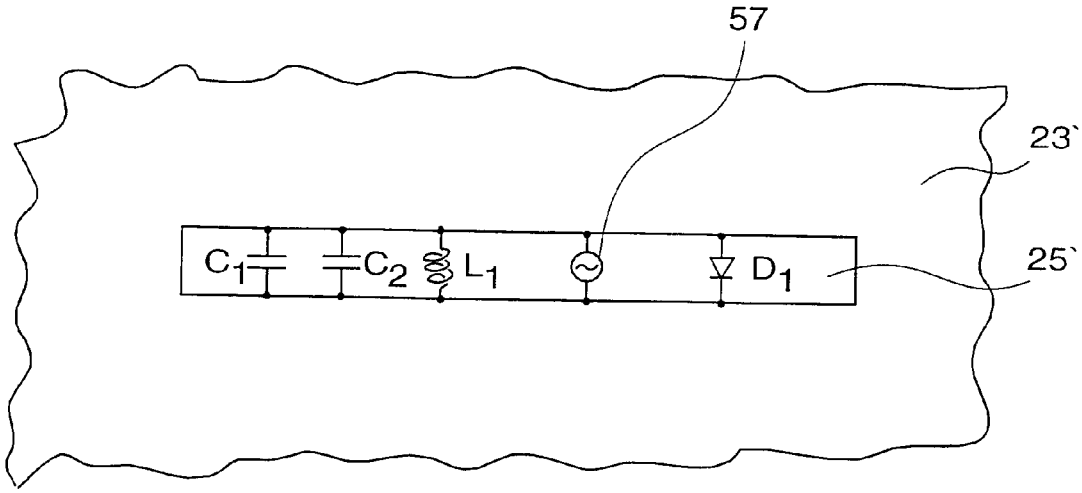
FIGS. 4*a* and 4*b* schematically illustrate parts of slot antenna layers provided with radiation affecting components, connected over the slot, according to an alternative embodiment of the present invention.
Figure 4B:
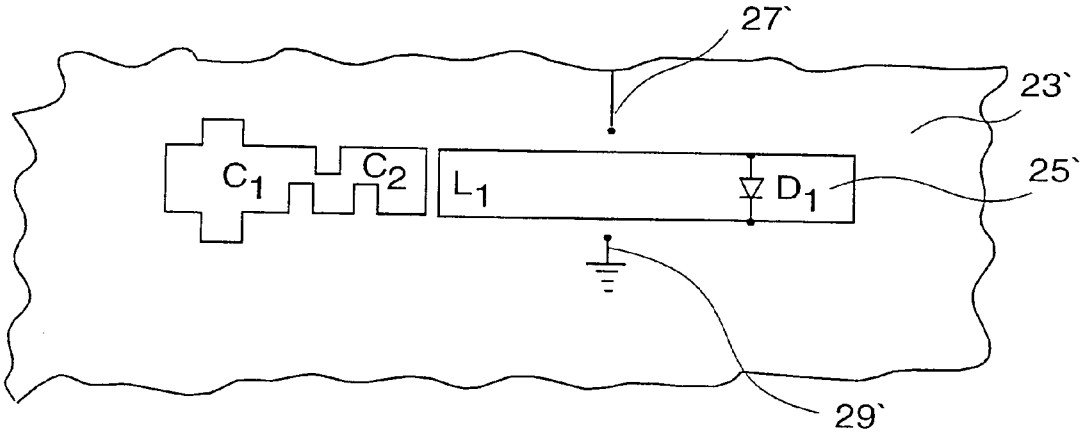

FIGS. 4*a* and 4*b* schematically illustrate parts of a patch layer 23' provided with radiation affecting components $C_1$, $C_2$, $L_1$ and $D_1$ connected over a slot 25' according to an alternative embodiment of the present invention. FIG. 4*a* shows electrical equivalent symbols connected over the slot 25' and a feed device 57 for feeding the slot 25'. FIG. 4*b* illustrates an example of implementations of the components shown in FIG. 4*a*, and also indicates a feeding point 27' and a grounding point 29'.

As shown in FIGS. 4*a* and 4*b*, two capacitors $C_1$ and $C_2$ are connected across the slot, $C_1$ being implemented as two notches at opposite sides of the slot 25' and $C_2$ being implemented as three protrusions, two at one side and the third at the opposite side of the slot 25'. Further, an inductor $L_1$ is connected across the slot, $L_1$ being implemented as a narrow strip across slot 25'. There is also provided an active component across the slot, here in the form of a diode $D_1$ interconnecting opposite sides of the slot 25'.

The design of this electric circuitry at the slot 25', together with the design of the patch layer 23' and the slot 25', may be chosen in order to obtain suitable antenna performance. The design may affect any of a set of radiation related parameters, such as resonance frequency, input impedance, bandwidth, radiation pattern, gain, polarization and near-field pattern.

It will be obvious that the invention may be varied in a plurality of ways. Such variations are not to be regarded as a departure from the scope of the invention. All such modifications as would be obvious to one skilled in the art are intended to be included within the scope of the appended claims.

What is claimed is:

1. An antenna device for at least one of transmitting and receiving radio frequency (RF) waves and that is connectable to a radio communication device including signal processing circuitry, the antenna device comprising:

a substantially planar conductive antenna element provided with a feeding point, a grounding point and a slot located between the feeding point and the grounding point;

a substantially planar ground conductor in a plane substantially parallel with said planar conductive antenna element;

a grounding connector that connects said planar ground conductor to the grounding point; and a feeding connector that connects the signal processing circuitry to the feeding point, the antenna device being connectable to the radio communication device such that said planar ground conductor is located between said planar conductive antenna element and the signal processing circuitry to shield the signal processing circuitry from RF waves.

2. The antenna device of claim 1, wherein said planar ground conductor has a planar extension that is at least a same size as a planar extension of said planar conductive antenna element.

3. The antenna device of claim 1, wherein a dielectric layer of a predetermined thickness is provided between said planar conductive antenna element and said planar ground conductor.

4. The antenna device of claim 1, wherein said grounding connector connects said planar ground conductor to the grounding point resistively.

5. The antenna device of claim 1, wherein said grounding connector connects said planar ground conductor to the grounding point capacitively.

6. The antenna device of claim 1, wherein the feeding point is resistively fed with RF waves.

7. The antenna device of claim 1, wherein the feeding point is capacitively fed with RF waves.

8. The antenna device of claim 1, wherein said feeding connector is a coaxial line connector.

9. The antenna device of claim 1, further comprising at least one electric RF component connected in between the feeding point and the signal processing circuitry, and arranged such that said planar ground conductor is located between said planar conductive antenna element and said at least one electric RF component to shield said at least one electric RF component from RF waves.

10. The antenna device of claim 9, wherein said at least one electric RF component comprises a bandpass filter that bandpass filters a signal fed to or received from the feeding point.

11. The antenna device of claim 9, wherein said at least one electric RF component comprises a power amplifier that amplifies a signal fed to the feeding point.

12. The antenna device of claim 9, wherein said at least one electric RF component comprises at least one low noise amplifier that amplifies a signal received from the feeding point.

13. The antenna device of claim 9, wherein said at least one electric RF component comprises a frequency converter that frequency converts a signal fed to or received from said feeding point.

14. The antenna device of claim 9, wherein said at least one electric RF component comprises an analog-digital converter that converts a received analog signal from the feeding point to digital form.

15. The antenna device of claim 9, wherein said at least one electric RF component comprises a digital-analog converter that converts a digital signal from the signal processing circuitry to an analog signal, which is fed to the feeding point.

16. The antenna device of claim 9, further comprising a radiation shielding structure surrounding said at least one electric RF component in all directions, except in a direction toward said planar ground conductor.

17. The antenna device of claim 16, wherein said radiation shielding structure has a shielding can shape.

18. The antenna device of claim 16, wherein said radiation shielding structure is comprised of a conductive material or a conductive film formed on a surface thereof.

19. The antenna device of claim 9, wherein said planar conductive antenna element, said planar ground conductor, and said at least one electric RF component are arranged on a multilayer printed circuit board.

20. The antenna device of claim 19, wherein the multilayer printed circuit board comprises:

a first conductive top layer which includes said planar conductive antenna element and the slot formed therein;

a second dielectric layer that insulates said first conductive top layer from a third conductive layer, the third conductive layer being said planar ground conductor; and a fourth dielectric layer that insulates the third layer from a fifth bottom layer, said at least one electric RF component being arranged in the fifth bottom layer.

21. The antenna device of claim 1, wherein said antenna element operates in at least two different frequency bands.

22. The antenna device of claim 21, wherein the slot and a planar extension of said planar conductive antenna element are designed to operate in the at least two different frequency bands.

23. The antenna device of claim 1, wherein the slot generally has any one of U, V, W, H and Ω shape.

24. The antenna device of claim 1, wherein the slot comprises resonance frequency affecting circuitry.

25. The antenna device of claim 24, wherein said resonance frequency affecting circuitry comprises at least one of a capacitor and an inductor.

26. The antenna device of claim 25, wherein said at least one of the capacitor and the inductor is connected across the slot to interconnect opposite sides of the slot.

27. The antenna device of claim 24, wherein said resonance frequency affecting circuitry comprises a diode.

28. The antenna device of claim 1, wherein said planar conductive antenna element includes a second feeding point, the antenna device further comprising a connector connected to the second feeding point and connectable to an external antenna.

29. The antenna device of claim 1, wherein said planar ground conductor is connectable to a grounding conductor provided in the radio communication device.

30. The antenna device of claim 1, further comprising dielectric top and bottom cover parts.

31. The antenna device of claim 1, wherein the radio communication device is portable or handheld.

32. The antenna device of claim 1, wherein said planar conductor is located between said planar conductive antenna element and the signal processing circuitry to additionally reduce antenna losses and efficiently utilize available space within the antenna device.

33. An antenna device for at least one of transmitting and receiving radio frequency (RF) waves and that is connectable to a radio communication device including signal processing circuitry, the antenna device comprising:

a substantially planar conductive antenna element provided with a feeding point, a grounding point and a slot located between the feeding point and the grounding point;

a substantially planar RF ground conductor in a plane substantially parallel with said planar conductive antenna element;

a grounding connector that connects said planar RF ground conductor to the grounding point;

a feeding connector that connects the signal processing circuitry to the feeding point; and at least one electric RF component connected between the feeding point and the signal processing circuitry, said planar RF ground conductor being located between said planar conductive antenna element and said at least one electric RF component to shield said at least one electric RF component from RF waves.

34. The slot antenna device of claim 33, wherein the radio communication device is portable or handheld.

35. The antenna device of claim 33, wherein said planar RF ground conductor is located between said planar conductive antenna element and said at least one electric RF component to additionally reduce antenna losses and efficiently utilize available space within the antenna device.

* * * * *